US005924134A

United States Patent [19]

Taylor et al.

[11] Patent Number: 5,924,134

[45] **Date of Patent: *Jul. 20, 1999**

[54] PROTECTIVE GARMENT WITH APERTURED CLOSED-CELL FOAM LINER

[75] Inventors: Frank Pratt Taylor, Dayton; Donald Aldridge, New Carlisle, both of Ohio

[73] Assignee: Lion Apparel, Inc., Dayton, Ohio

[ * ] Notice: This patent is subject to a terminal disclaimer.

[21] Appl. No.: 08/857,092

[22] Filed: May 15, 1997

Related U.S. Application Data

[63] Continuation-in-part of application No. 08/596,702, Feb. 5, 1996, Pat. No. 5,697,101, which is a continuation of application No. 08/119,474, Sep. 10, 1993, abandoned.

[51] Int. Cl.[6] ..... A41D 13/00

[52] U.S. Cl. ..... 2/81; 2/97; 2/458

[58] Field of Search ..... 2/81, 97, 458, 2/272

[56] References Cited

U.S. PATENT DOCUMENTS

| | | | |
|---|---|---|---|
| 2,570,182 | 10/1951 | Daly et al. | 260/2.5 |
| 2,976,539 | 3/1961 | Brown, Jr. | 2/2 |
| 2,981,954 | 5/1961 | Garbellano | 2/2.1 |
| 4,034,417 | 7/1977 | Ellis | 2/81 |
| 4,495,661 | 1/1985 | Kamat | 2/97 |
| 4,502,153 | 3/1985 | Lapedes et al. | 2/81 |
| 4,583,247 | 4/1986 | Fingerhut et al. | 2/69 |
| 4,604,759 | 8/1986 | Bowman et al. | 2/81 |
| 4,685,155 | 8/1987 | Fingerhut et al. | 2/272 |
| 4,805,244 | 2/1989 | Scott | 2/272 |
| 4,843,646 | 7/1989 | Grilliot et al. | 2/69 |
| 4,860,382 | 8/1989 | Markwell | 2/82 |
| 4,922,552 | 5/1990 | Grilliot et al. | 2/93 |
| 4,994,317 | 2/1991 | Dugan et al. | 428/246 |
| 4,999,850 | 3/1991 | Grilliot et al. | 2/126 |
| 5,001,781 | 3/1991 | Grilliot et al. | 2/69 |
| 5,021,280 | 6/1991 | Farnworth et al. | 428/102 |
| 5,044,031 | 9/1991 | Sherwood et al. | 5/481 |
| 5,054,125 | 10/1991 | Snedeker | 2/81 |
| 5,136,723 | 8/1992 | Aldridge et al. | 2/81 |
| 5,299,602 | 5/1994 | Barbeau et al. | 2/81 |
| 5,499,663 | 3/1996 | Barbeau et al. | 2/81 |
| 5,701,606 | 12/1997 | Aldridge | 2/81 |

OTHER PUBLICATIONS

Diverlink guide to wetsuits. Downloaded from internet on Aug. 25, 1998. See p. 2 of 26.

Mustang Industries Marine Wear Brochure, 1986.

Product Information, Mustang Aviation Coverall, 1983.

Mustang Manufacturing Inc. Aviation Coverall, 1992.

Patagonia, Inc. Impact Tights, 1993.

*Primary Examiner*—Diana L. Oleksa

*Attorney, Agent, or Firm*—Thompson Hine & Flory LLP

[57] ABSTRACT

A protective garment including an outer shell, a thermal liner and a moisture barrier, in which the thermal liner includes a flame and heat resistant apertured closed-cell foam laminate. The apertured closed-cell foam laminate comprises a layer of apertured closed-cell foam material positioned between and bonded to a substrate of woven aramid material and a substrate of aramid material of a lesser or equal grade. The thermal liner is appreciably non-moisture absorbent and provides high thermal insulation for its weight and thickness in comparison to prior art thermal liners. Accordingly, the overall weight of the garment is minimized, as is the movement-restricting effect of the liner. The non-absorbency of the thermal liner allows the liner to be positioned between the moisture barrier and the outer shell of the garment so that the liner does not restrict flow of perspiration moisture vapor from the wearer to the moisture barrier. The apertures formed in the foam layer promote transport through the liner of moisture vapor from the wearer which passes through the moisture barrier.

30 Claims, 1 Drawing Sheet

PROTECTIVE GARMENT WITH APERTURED CLOSED-CELL FOAM LINER

CROSS REFERENCE TO RELATED APPLICATION

This application is a continuation-in-part of U.S. Ser. No. 08/596,702 filed Feb. 5, 1996(now U.S. Pat. No. 5,697,101), which is a continuation of U.S. Ser. No. 08/119,474 filed Sep. 10, 1993, now abandoned.

BACKGROUND OF THE INVENTION

The present invention relates to garments which protect the wearer from hazardous environmental conditions and, more particularly, to garments which provide the wearer with protection from extreme ambient conditions.

Protective garments are designed to shield the wearer from a variety of environmental hazards, and firefighter garments are representative of such garments. For example, a typical firefighter garment includes an outer shell and an inner liner including a moisture barrier and a thermal barrier. The outer shell consists of a woven aramid material such as NOMEX, KEVLAR (both trademarks of E.I. DuPont de Nemours & Co., Inc.) or a NOMEX/KEVLAR blend, or a woven polybenzamidazole ("PBI") and aramid polymer fabric blend. Fabrics of such materials provide resistance to abrasion and some thermal protection.

The thermal barrier may comprise a layer of NOMEX and KEVLAR fibers, or a batting of such fibers, often quilted to a lightweight NOMEX face cloth. The batting of the thermal barrier traps air and possesses sufficient loft to provide the necessary thermal resistance, and the face cloth protects the thermal liner from abrasion by the wearer.

Moisture resistance is provided by a membrane of expanded polytetrafluoroethylene ("PTFE") material, such as GORE-TEX (a trademark of W. L. Gore & Associates, Inc.), bonded adhesively to a fabric substrate of a NOMEX and KEVLAR blend. The GORE-TEX membrane material has microscopic openings which permit the transport of moisture vapor, thereby allowing perspiration moisture vapor of the wearer to escape outwardly, but are sufficiently small to prevent liquid moisture from the ambient, which soaks through the outer shell (or enters through sleeve or neck openings), from passing through to the wearer.

The aforementioned ensemble possesses acceptable abrasion, thermal and moisture resistance properties. The conventional arrangement of the components within the garment is such that the moisture barrier layer is positioned between the thermal liner and the outer shell. This is necessary to prevent the batting material of the thermal liner from absorbing moisture from the ambient, which would add to the overall weight of the garment and possibly reduce its loft and thermal resistance characteristics.

A disadvantage with such an arrangement is that the presence of the thermal liner between the moisture barrier and the wearer acts as a barrier which. inhibits free flow of perspiration moisture vapor from the wearer to and through the moisture barrier layer. Consequently, in high activity or stress situations, perspiration moisture vapor generated by the wearer may become trapped within the thermal liner, thus wetting the thermal liner, which adds weight to the garment and lowers the TPP (Thermal Protection Property) of the thermal liner.

Another disadvantage with such prior art garments is that the additional bulk and loft provided by such fabric thermal liners inhibits the freedom of movement of the wearer, producing a "hobbling effect," and requires the use of a face cloth, which increases the cost of the garment. The former disadvantage increases the stress imposed on the wearer in a situation requiring high activity, and accelerates the onset of fatigue.

Another type of firefighter garment, disclosed in Aldridge et al. U.S. Pat. No. 5,136,723, utilizes a thermal liner consisting essentially of a layer or layers of open mesh fabric. In addition to trapping a layer of air between the wearer and the shell of that garment, the open apertures promote heat and perspiration vapor transfer from the wearer's body. However, since such mesh fabric absorbs liquid moisture, it is preferable to place such a thermal liner inside of the moisture barrier; that is, between the wearer and the moisture barrier. Consequently, such a mesh barrier may impede the outward transport of moisture vapor somewhat.

For a protective garment to be suitable for use as a firefighting garment, the garment must meet the National Fire Protection Association 1971 Standard (hereinafter "N.F.P.A. 1971 Standard"). The N.F.P.A. 1971 Standard includes a requirement that a component of such garment withstand a temperature of 500° F. for 5 minutes in a forced air oven. A component subjected to such a temperature for such a time cannot melt, drip, separate or ignite, nor can it shrink more than 10%. Additionally, all garment layers combined must provide a thermal protection performance ("TPP") rating of at least 35.

"Neoprene" is a name for a type of synthetic rubber comprising polychloroprene. Neoprene alone does not meet the N.F.P.A. 1971 Standard for flame and heat resistance and therefore is not sufficiently flame and heat resistant to be used in a firefighter garment. But neoprene can be made more flame and heat resistant by adding a chemical such as antimony oxide during the compounding process. Several prior art patents, such as U.S. Pat. No. 2,981,954 to Garbellano, U.S. Pat. No. 5,054,125 to Snedeker, U.S. Pat. No. 4,034,417 to Ellis and U.S. Pat. No. 5,021,280 to Farnworth, disclose thermal liners for various garments that include a layer of neoprene material. But these prior art patents do not disclose that the neoprene material has been treated to increase its flame and heat resistance.

U.S. Pat. No. 2,976,539 to Brown Jr. discloses a cold weather garment comprising at least two sheets of heat insulating material, such as expanded closed-cell cellular rubber and rubberlike material or plasticized polyvinyl chloride material. Such materials are not suitable for use in a firefighter garment, however, because, when incorporated into a component of a coat, such component does not possess sufficient flame and heat resistance to meet the N.F.P.A. 1971 Standard.

Accordingly, there is a need for a firefighting garment in which the transport of moisture vapor generated by the perspiration of the wearer is permitted to flow freely to and through the thermal barrier; which is relatively thin and light in weight, yet provides adequate thermal protection; which is inherently able to withstand a temperature of 500° F. for at least 5 minutes; and which minimizes the restriction of movement and hobbling effect characteristic of insulated garments.

SUMMARY OF THE INVENTION

The present invention is a protective garment having relatively lightweight, relatively high resistance to water absorption and relatively high moisture vapor transport characteristics when compared to conventional firefighter garments. The garment of the present invention comprises an outer shell, a thermal liner and a moisture barrier, in which the thermal liner includes an apertured closed-cell foam laminate. The apertured closed-cell foam laminate comprises a layer of flame and heat resistant apertured closed-cell foam material positioned between, and bonded to, a layer of woven aramid material and a layer of aramid material of an equal or lower grade. The apertured closed-cell foam laminate is inherently able to withstand temperatures of 500° F. for at least 5 minutes without melting, dripping, separating or igniting, and provides sufficient thermal insulation to meet or exceed N.F.P.A. (National Fire Protection Association) requirements, yet it is lighter in weight than conventional batting or other fabric-type thermal barriers of similar insulation value. Furthermore, by encasing the foam material between layers of fabric, the foam is protected from disintegrating from friction with other layers of the garment.

Two characteristics of the closed-cell foam provide thermal insulation advantages. First, the closed-cell structure of the foam provides superior insulating properties when compared to air-permeable fibers of prior art garment insulation products, on weight and thickness bases. Second, a sheet of the closed-cell foam of the present invention is more dimensionally stable and uniform in thickness than a comparable sheet of prior art fiber insulation, so that a sheet of the closed-cell foam can be made thinner and still meet the minimum overall N.F.P.A. requirements for a garment. Because the insulation layer can be made thinner, the overall size and bulk of the garment is reduced significantly. This reduces the amount of material required for the garment, thereby reducing the overall cost of the garment as well as minimizing the hobbling effect of such a liner, thereby reducing stress and fatigue.

A thermal liner including the apertured closed-cell foam laminate of the present invention does not absorb significant amounts of liquid moisture and can be placed outside the moisture barrier, between the moisture barrier and the outer shell. With this arrangement of the layers, the moisture barrier membrane is positioned as close as possible to the wearer to maximize the flow of moisture vapor from the wearer through the moisture barrier. Since the thermal liner is on the opposite side of the moisture barrier from the wearer, the chance of the wearer being scalded by a heated thermal liner saturated with moisture is significantly reduced. Such an occurrence is further reduced since the closed-cell foam layer of the thermal liner of the present invention does not readily absorb water.

Further, the moisture barrier substrate, typically a woven blend of aramid polymer materials such as NOMEX and KEVLAR, is against the wearer and thereby eliminates the need for a separate face cloth to protect the thermal liner, as with prior art garments. Accordingly, this orientation and construction further reduces the overall weight and cost of the garment.

Consequently, the thermal liner including the apertured closed-cell foam laminate of the present invention functions similarly to the mesh thermal liner of Aldridge et al. U.S. Pat. No. 5,136,723 in that the apertures of the closed-cell foam layer of the present invention promote the transport of moisture vapor (typically from perspiration) outwardly from the wearer. Furthermore, like the mesh apertures of the garment of the Aldridge et al. patent, the apertures in the closed-cell foam layer can perform an insulating function, provided that the apertures are sized sufficiently small. However, the use of a closed-cell foam layer as the matrix for the apertures of the thermal liner of the present invention not only provides improved insulation values, but enables the thermal liner to be positioned outside of the moisture barrier.

In addition to providing protection to the foam layer from abrasion, the outer, aramid material layers of the apertured closed-cell foam laminate of the present invention provide support and protection to the middle layer of apertured closed-cell foam from heat and flame. The woven aramid material layer also substantially resists tears and abrasions, and therefore, further helps the thermal liner to meet the N.F.P.A. 1971 Standard for tear and abrasion resistance.

In one embodiment of the invention, the outer shell of the garment itself acts as one of the outer, aramid layers of the laminate. The apertured closed-cell foam layer is bonded to the outer shell and the other layer of aramid material by an adhesive. The moisture barrier is separate from the laminate formed by the outer shell layer, the apertured-closed cell foam layer, and the inner layer of aramid material. Accordingly, the outer shell acts as a supportive substrate for the apertured closed-cell foam layer so that the combination of the shell and liner meet the N.F.P.A. 1971 Standard requirements for tear strength.

In another embodiment of the invention, the apertured-closed cell foam laminate is separate from both the moisture barrier and the outer shell and is removable from the garment. With this embodiment, all the layers of the ensemble can be separated to facilitate repair, maintenance, cleaning and replacement.

Accordingly, it is an object of the present invention to provide a protective garment with a thermal liner which provides thermal resistance and moisture resistance; a protective garment in which the thermal liner is relatively lightweight and resilient, yet possesses the necessary TPP ratings to meet N.F.P.A. standards; a protective garment having a thermal liner that does not melt, drip, separate or ignite when exposed to a temperature of 500° F. for 5 minutes; a protective garment having thermal liner that is relatively simple to construct, launder and maintain; a protective garment in which the thermal liner is relatively thin and uniform, thereby minimizing the bulk such a layer adds to a garment, which reduces the hobbling effect of such a garment and the cost of additional material; and a protective garment having a thermal liner and moisture barrier in which the thermal liner can be placed outside of the moisture barrier, thereby enhancing the transport of moisture vapor from the wearer outwardly to the outer shell and eliminating the need for a layer of face cloth material.

Other objects and advantages of the present invention will be apparent from the following description, the accompanying drawings and the appended claims.

DETAILED DESCRIPTION

Figure 1:
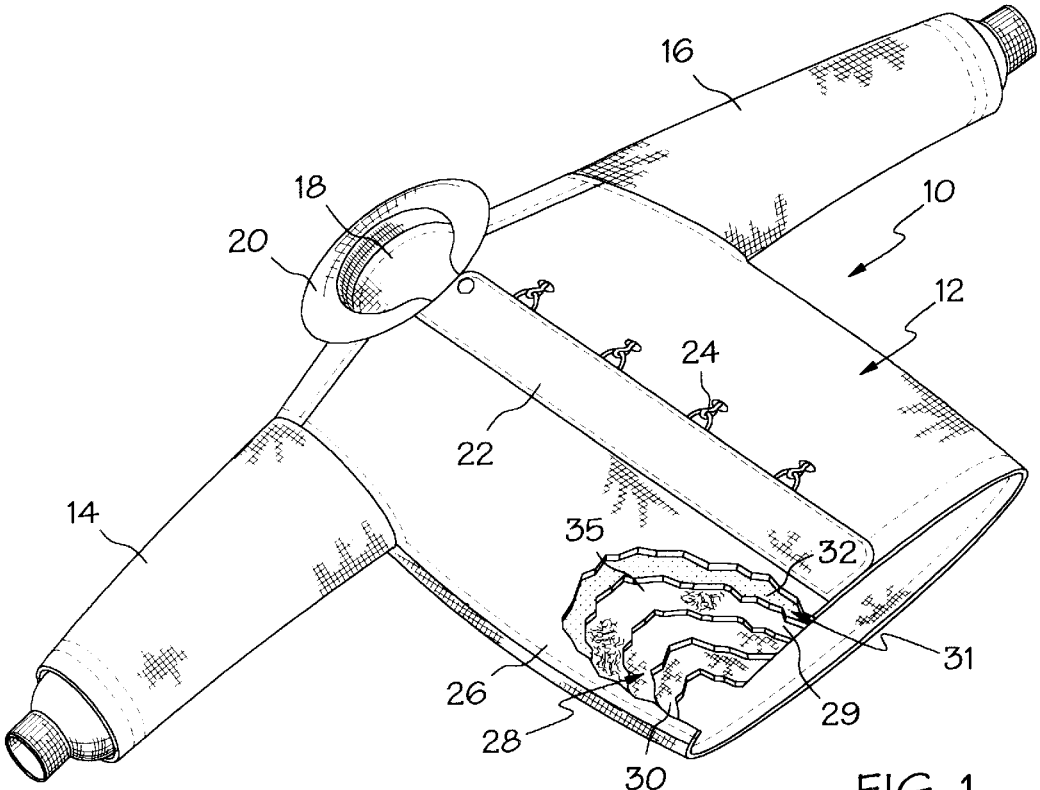
FIG. 1 is a somewhat schematic, perspective view of a firefighter garment incorporating an embodiment of the present invention.

As shown in FIG. 1, the protective garment of the present invention is embodied in a protective garment in the form of a firefighter garment, generally designated 10, which is a firefighter turnout coat having a body portion 12, sleeves 14, 16, a neck opening 18, a collar 20 surrounding the neck opening, and a front closure, generally designated 22. The front closure 22 is of conventional design and may comprise snaps or, alternately, strips of hook and loop fastener material (not shown) in combination with mechanical locking means such as hook and "D" combinations 24.

Figure 2:
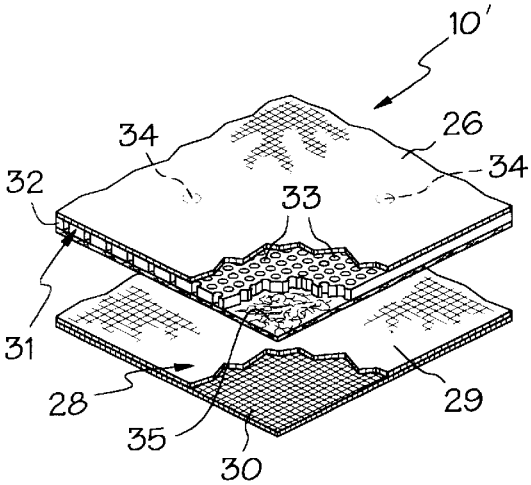
FIG. 2 is an exploded, perspective detail of the garment of FIG. 1 showing the layers of material comprising the ensemble.

As shown in FIGS. 1 and 2, the garment 10 includes an outer shell, generally designated 26, of an aramid material, such as NOMEX, or a blend of aramid and PBI 5 material, which covers the entire garment. Extending throughout the garment 10 is an inner moisture barrier layer 28. The moisture barrier layer 28 preferably consists of a membrane 29 of expanded PTFE material, such as GORE-TEX, attached adhesively to a fabric substrate 30 of an aramid polymer material blend, such as NOMEX and KEVLAR.

A thermal liner, generally designated 31, extends throughout the garment 10 and includes a layer 32 of closed-cell foam material which is provided with a multiplicity of apertures 33 extending therethrough and a substrate 35 of aramid fabric material, bonded to an inner surface of the foam layer 32. The apertures 33 preferably are about ⅛ inch in diameter and are arranged in a pattern of about 32 apertures per square inch. Such dimensions and arrangement provide for approximately 28.5% open area in the foam layer 32. However, other aperture sizes and densities may be employed without departing from that scope and intent of the invention. For example, it is within the scope of the invention to have aperture diameters ranging from 1/16 inches to ½ inches, having respective densities of the apertures ranging from 5 apertures per square inch to 40 apertures per square inch, which correspond to 15% open area to 60% open area in the foam layer 32.

The foam layer 32 of the thermal liner 31 preferably is between 3/32 and ⅛ inches thick and is made of a flame and heat resistant material, such as ENSOLITE styles IV1, IV2, IV3, IV4, IV5, GIC or IVC, manufactured by Rubatex Corp. of Roanoke, Va. Tests indicate that a composite of style GIC foam laminated to a layer of NOMEX can withstand melting, dripping, separating and igniting when exposed to temperatures of 500° F. for at least 5 minutes.

The foam layer 32 is bonded by a suitable adhesive to the shell 26 and to the substrate layer 35, preferably by a pattern of "dots" 34 of adhesive so that the apertures 32 generally are not blocked. The dots 34 are shown larger than actual size in the figures for clarity, and actually are about 1 mm in diameter. Accordingly, the thermal liner 31 is formed from a laminate that includes the outer shell 26, the foam layer 32, and the inner substrate layer 35. The inner substrate layer 35 may be a lesser grade fabric than the outer shell 26, such as a non-woven or matted fabric.

Figure 3:
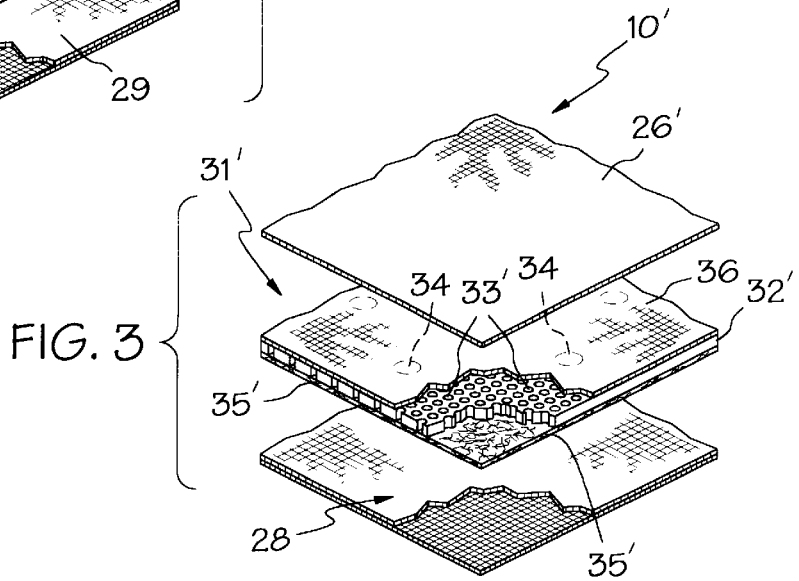
FIG. 3 is an exploded, perspective detail similar to FIG. 2, but of an alternate embodiment of the invention.

An alternative embodiment of the invention is shown in FIG. 3. With the garment 10', the thermal liner 31' is positioned between shell 26' and moisture barrier 28, but is unattached to the shell. With this embodiment, the thermal liner 31' is a laminate consisting of a middle, apertured foam layer 32' bonded by dots 34 of a suitable adhesive between a substrate 36 of a woven aramid polymer material and a substrate 35' of an aramid polymer material of a lesser grade. A preferred adhesive consists of the same adhesive used to bond the membrane 29 to the substrate 30 of the moisture barrier 28. Consequently, the thermal liner 31' is separable and removable from the outer shell 26' and moisture barrier 28 for replacement, maintenance or laundering.

The outer substrate 36 provides dimensional stability and to meet the tear strength requirements of N.F.P.A.. And both the inner and outer substrates 35', 36 protect the foam layer 32' from excessive heat, and protect the foam layer 32' from erosion and breaking apart.

It should be apparent to one of ordinary skill in the art that the woven aramid polymer substrate layer 36 can be either the inner or outer substrate layer; and that both substrate layers can be made from the finer grade fabric, such as the woven aramid polymer substrate layer 36. The primary reason for the substrate layer 35' being a lesser grade fabric is for cost savings.

It is also within the scope of the present invention that one or both of the substrate layers 35', 36 be a high-temperature polyester film material, such as a MYLAR film material (a registered trademark of E.I. DuPont de Nemours & Co., Inc.). If a film substrate layer or layers were used, the layer would need to include a multiplicity of apertures therethrough to provide the necessary breathability of the thermal liner. Alternatively, a perforated polyester film substrate could be laminated to the foam layer.

With the garments 10, 10' of FIGS. 2 and 3, respectively, by positioning the thermal liners 31, 31' between the moisture barriers 28 and outer shells 26, 26', the thermal liners no longer obstruct the free flow outward of moisture vapor, such as perspiration moisture vapor generated by a wearer during strenuous activity, through the moisture barrier 28. Consequently, the build-up of perspiration moisture within the garment is significantly reduced. This arrangement is made possible by the inherent properties of the closed-cell foam layer 32, 32'. Such a garment will possess advantages over traditional firefighter garments in that the closed-cell foam material is lighter in weight than a traditional thermal liner of a comparable TPP rating.

Another advantage with such an arrangement is that the closed-cell foam material does not appreciably absorb water, so that the overall ensemble does not gain as much weight in conditions of high water saturation, and therefore reduces stress on the wearer since the weight is reduced. Furthermore, the TPP rating will remain more constant than prior art thermal liners, regardless of the amount of water saturation of the garment, since the thermal liner resists absorbing water.

The method of manufacturing the garment 10 of the present invention is similar to conventional methods. However, the outer shell is made of a laminate of aramid outer shell material, closed-cell apertured foam, and aramid substrate material. The laminate is prepared in roll form, and the three layers are cut and sewn together to make the combination outer shell and thermal liner. The moisture barrier is separately made by laminating a semi-permeable membrane to a fabric substrate, and is inserted into the outer shell and secured at the peripheries of the outer shell and moisture barrier by snaps, strips of hook and loop material, or permanently by stitching.

In the embodiment of FIG. 3, the closed-cell foam layer is first bonded in-between the two fabric substrate layers and supplied in roll form. The patterns of liner are cut from the roll, stitched into the desired garment shape and inserted into a conventional outer shell. The moisture barrier laminate of membrane and substrate is then inserted into the garment. The separate layers are attached to each other by snaps, strips of hook and loop material or permanently by stitching.

While the forms of apparatus herein described constitute preferred embodiments of this invention, it is to be understood that the invention is not limited to these precise forms of apparatus, and that changes may be made therein without departing from the scope of the invention.

What is claimed is:

1. A thermal liner for a hazardous-duty garment comprising:

a layer of closed-cell foam material;

a first substrate of fabric material attached to one side of said layer of closed-cell foam material, thereby imparting dimensional stability to said layer of closed-cell foam material; and a second substrate of fabric material attached to an opposite side of said layer of closed-cell foam material, thereby imparting dimensional stability to said layer of closed-cell foam material;

wherein said layer of closed-cell foam material includes a multiplicity of apertures extending therethrough.

2. The thermal liner of claim 1, wherein said substrates of fabric material are bonded to said layer of closed-cell foam material.

3. The thermal liner of claim 2, wherein said first and second substrate layers are of an aramid material.

4. The thermal liner of claim 3, wherein one of said first and second substrate layers includes filament material.

5. The thermal liner of claim 4, wherein said closed-cell foam material is flame and heat resistant.

6. The thermal liner of claim 4, wherein one of said substrate layers includes a spun material.

7. A protective garment comprising:

an outer shell; and a laminate liner positioned within said outer shell, said liner including a layer of continuous, closed-cell foam material, a first substrate of fabric material bonded to one side of said layer of closed-cell foam material, and a second substrate of fabric material bonded to an opposite side of said closed-cell foam layer;

said closed-cell foam layer including a multiplicity of apertures extending therethrough;

whereby said laminate liner provides thermal protection to a wearer of the garment, yet substantially does not absorb moisture;

and whereby said multiplicity of apertures allow passage of moisture vapor outwardly from a wearer of the garment through said laminate liner.

8. The garment of claim 7 further comprising a layer of moisture barrier material adjacent to said laminate liner.

9. The garment of claim 8 wherein said moisture barrier layer includes a semi-permeable membrane that allows the passage of moisture vapor therethrough but prevents the passage of liquid moisture therethrough.

10. The garment of claim 9 wherein said laminate liner is positioned adjacent to said outer shell; and said moisture barrier layer is positioned between said laminate liner and a wearer of the garment.

11. The garment of claim 9 wherein said liner is bonded to an interior surface of said outer shell by an adhesive.

12. The garment of claim 7 wherein said layer of foam material is between approximately 1/16 inches (1.588 mm) and 1/8 inches (3.175 mm) thick.

13. The garment of claim 7 wherein said laminate liner extends only in selected portions of such garment, said laminate liner providing increased resistance to heat and compression.

14. The garment of claim 7 wherein said closed-cell foam material is flame and heat resistant.

15. The garment of claim 7 wherein substantially all of said apertures are approximately 1/8 inches (3.175 mm) in diameter.

16. The garment of claim 7 further comprising a plurality of dots of adhesive bonding said first and second substrate layers to said closed-cell foam layer.

17. The garment of claim 16 wherein said dots each are approximately 1 mm in diameter.

18. The garment of claim 7 wherein said outer shell comprises a woven aramid fiber material.

19. The garment of claim 7 wherein said substrates of fabric material include a filament yarn.

20. The garment of claim 19 wherein said substrates of fabric material include an aramid material.

21. The garment of claim 20, wherein one of said first and second substrate layers is woven.

22. The garment of claim 21, wherein said closed-cell foam material is flame and heat resistant.

23. The thermal liner of claim 7 wherein said thermal liner withstands melting, dripping, separating and igniting when exposed to temperatures of 500° F. for at least 5 minutes.

24. A thermal liner for a hazardous-duty garment comprising:

a layer of closed-cell foam material;

a first substrate taken from a group consisting of a breathable aramid fabric material and a polymer film, said first substrate being bonded to one side of said layer of closed-cell foam material; and a second substrate taken from a group consisting of a breathable aramid polymer fabric material and a polymer film, said second substrate being bonded to an opposite side of said layer of closed-cell foam material.

25. The thermal liner of claim 24, wherein said layer of closed-cell foam material includes a multiplicity of apertures extending therethrough.

26. The thermal liner of claim 24, wherein one of said first and second substrates include a filament yarn polymer fabric material.

27. The thermal liner of claim 26, wherein said thermal liner withstands melting, dripping, separating and igniting when exposed to temperatures of 500° F. for at least 5 minutes.

28. A method of constructing a relatively light weight, low volume protective garment comprising the steps of:

providing an outer shell of an abrasion resistant and fire-retardant material;

providing a thermal liner laminate including, (a) a layer of a closed-cell foam having a multiplicity of apertures therethrough;

(b) a first substrate of fabric material bonded to one side of said layer of closed-cell foam; and (c) a second substrate of fabric material bonded to on opposite side of said layer of closed-cell foam; and assembling said thermal liner laminate and said outer shell by positioning said thermal liner laminate within said outer shell, whereby said thermal liner is positioned to promote flow of moisture vapor transport therethrough from a wearer of said garment to said outer shell.

29. The method of claim 28 further comprising the steps of providing a moisture barrier layer having a membrane permeable to moisture vapor; and assembling said garment by inserting said moisture barrier layer within said thermal liner, such that said thermal liner is positioned between said moisture barrier layer and said outer shell.

30. The method of claim 28 wherein said thermal liner providing step includes the step of selecting materials for said thermal liner such that said assembled thermal liner laminate withstands melting, dripping, separating and igniting when exposed to temperatures of 500° F. for at least 5 minutes.

* * * * *